US009677813B2

(12) United States Patent
Bringewatt et al.

(10) Patent No.: US 9,677,813 B2
(45) Date of Patent: Jun. 13, 2017

(54) METHOD FOR DRYING LAUNDRY AND DRYER

(71) Applicant: Herbert Kannegiesser GmbH, Vlotho (DE)

(72) Inventors: Wilhelm Bringewatt, Porta Westfalica (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 475 days.

(21) Appl. No.: 13/784,865

(22) Filed: Mar. 5, 2013

(65) Prior Publication Data

US 2013/0239433 A1 Sep. 19, 2013

(30) Foreign Application Priority Data

Mar. 16, 2012 (DE) ..... 10 2012 005 199

(51) Int. Cl.
*F26B 19/00* (2006.01)
*F26B 23/00* (2006.01)
(Continued)

(52) U.S. Cl.
CPC ..... *F26B 23/002* (2013.01); *D06F 58/263* (2013.01); *D06F 58/28* (2013.01); *D06F 2058/289* (2013.01); *D06F 2058/2864* (2013.01)

(58) Field of Classification Search
CPC ..... F26B 23/002; F26B 11/028; D06F 2058/2854; D06F 58/26; D06F 58/263; D06F 2058/289
(Continued)

(56) References Cited

U.S. PATENT DOCUMENTS 3,604,824 A * 9/1971 Hardison ..... 431/116
3,882,613 A 5/1975 Wilson
(Continued)

FOREIGN PATENT DOCUMENTS

DE 3019814 A1 11/1980
DE 10349712 A1 6/2005
(Continued)

OTHER PUBLICATIONS

European Patent Office, European Search Report for related EP 13000720, Aug. 5, 2013.

*Primary Examiner* — Kenneth Rinehart
*Assistant Examiner* — John McCormack
(74) *Attorney, Agent, or Firm* — Laurence P. Colton; Smith Tempel Blaha LLC

(57) ABSTRACT

A method for providing fresh air fed through a fan to a burner of a dryer, thereby charging the burner, when the dryer is operated with recirculating air. In commercial dryers in which the drying air is heated by a burner, it is customary to reuse the moist air leaving a drum containing the laundry to be dried as recirculating air. The recirculating air component is increased with increasing drying of the laundry. At the end of the drying operation, when the moist air no longer contains as much moisture as at the start, the moist air is used as recirculating air. The burner then no longer gets enough combustion air, which leads to an incomplete combustion. The dryer can be operated with a higher recirculating air component, an optimal combustion being guaranteed through the charging of the burner with fresh air. The invention permits more economical drying.

13 Claims, 3 Drawing Sheets

(51) Int. Cl.
*D06F 58/26* (2006.01)
*D06F 58/28* (2006.01)

(58) Field of Classification Search
USPC ..... 34/551, 86, 152, 176, 199, 513, 549; 432/152, 176, 199; 431/5, 9
See application file for complete search history.

(56) References Cited

U.S. PATENT DOCUMENTS

| | | | | | |
|---|---|---|---|---|---|
| 3,995,988 | A * | 12/1976 | Freze | 432/21 | |
| 4,133,636 | A * | 1/1979 | Flynn | F23G 7/065 34/513 | |
| 4,626,201 | A * | 12/1986 | Grantham | D06F 58/263 432/105 | |
| 5,207,569 | A * | 5/1993 | Knopfel | F23N 1/02 431/6 | |
| 5,713,139 | A | 2/1998 | Briggs | | |
| 2008/0124668 | A1 * | 5/2008 | Schultz et al. | 431/89 | |

FOREIGN PATENT DOCUMENTS

| | | | |
|---|---|---|---|
| EP | 0053269 | A2 | 6/1982 |
| EP | 1134528 | A1 | 9/2001 |
| JP | H04300600 | A | 10/1992 |

* cited by examiner

METHOD FOR DRYING LAUNDRY AND DRYER

STATEMENT OF RELATED APPLICATIONS

This patent application is based on and claims the benefit of German Patent Application No. 10 2012 005 199.9 having a filing date of 16 Mar. 2012.

BACKGROUND OF THE INVENTION

Technical Field

The invention relates to a method for drying laundry, wherein air for drying the laundry is heated by a burner and, at least during a part of the drying operation, at least a part of the air used to dry the laundry is fed back to the burner as recirculating air, if need be together with fresh air, and to a dryer for laundry, comprising a drum for receiving the laundry to be dried and comprising at least one burner for heating air which serves for the drying.

Prior Art

Dryers for commercial laundries possess at least one burner, preferably a gas burner, for heating air which is used for drying. The air heated by the burner is passed through a preferably rotationally drivable drum containing the laundry to be dried. The air here absorbs moisture from the laundry to be dried. The moist air is afterwards led as waste air into the open and/or is fed back as recirculating air to the at least one burner and reheated by this.

At the beginning of the drying, the air leaving the drum contains the most humidity. This air cannot, or can only in small part, be reused as recirculating air. It must therefore, at least for the most part, be passed out of the dryer. At the beginning of the drying, only a small amount of recirculating air is therefore being carried. A large amount of fresh air is then fed, at least for the most part, via the burner to the dryer. As a result of this very large fresh air component, the at least one burner gets sufficient combustion air. At the conclusion of the drying operation, air having only a small amount of humidity leaves the drum. A relatively large amount of recirculating air and only a small amount of fresh air are then fed to the burner. The at least one burner then contains only very little fresh air or no fresh air at all, with the result that the burner works uneconomically. In many cases, an incomplete combustion with undesirable soot formation can ensue.

The object of the invention is to provide a method and a dryer for drying laundry, which can be operated with a relatively large recirculating air component, or with only recirculating air, economically and without negative impacts on combustion.

A method for the achievement of this object is a method for drying laundry, wherein air for drying the laundry is heated by a burner and, at least during a part of the drying operation, at least a part of the air used to dry the laundry is fed back to the burner as recirculating air, if need be together with fresh air, characterized in that the fresh air is transported to the burner at least during a part of the drying process. According to this, the fresh air is transported to the at least one burner at least during a part of the drying process. As a result of the active transport of fresh air to the burner, the fresh air is virtually blown or forced into the burner. A type of charging of the burner with fresh air occurs. As a result, the burner is also then supplied with sufficient fresh air if the recirculating air is returned in full or for the most part to the at least one burner without this adversely affecting the combustion. The drying can hence be realized with more recirculating air than previously. The inventive method thereby provides more economical drying.

A further advantageous embodiment of the method provides for, where necessary, feeding fresh air to the recirculating air after the recirculating air has been warmed by the respective burner. This happens before the warmed recirculating air has reached the laundry to be dried. In this way, only that quantity of fresh air which is necessary to the optimal operation of the burner needs to be fed to this same. If required, additional fresh air can be added directly to the warmed recirculating air, which can lead to more economical drying by, for example, increasing the amount of air available for drying the laundry.

An advantageous refinement of the method provides for the fresh air to be fed under pressure, preferably through at least one fan or a blower, to the burner. This type of transport of the fresh air to the at least one burner represents the simplest and most effective charging of the burner. Through adjustment of the fan speed, the quantity of fresh air fed to the burner can be adjusted or controlled in accordance with requirements, so that the respective burner receives as much fresh air as it requires, based on the respective recirculating air component. The burner can thus receive that quantity of fresh air which is required for the, in each drying phase, optimal operation, wherein the quantity of fresh air can be increased the greater the recirculating air component becomes which is returned to at least one burner.

A further advantageous embodiment of the method provides for, where necessary, fresh air to also be fed behind the respective burner to the recirculating air warmed by this same. This happens before the warmed recirculating air has reached the laundry to be dried. In this way, only that quantity of fresh air which is necessary to the optimal operation of the burner needs to be fed to this same. Fresh air which is required over and above this can be fed directly to the warmed recirculating air. That too leads to more economical drying.

A dryer for the achievement of the object stated in the introduction is a dryer for laundry, comprising a drum for receiving the laundry to be dried and comprising at least one burner for heating air which serves for the drying, characterized in that an air flow generator for the transport of fresh air to the burner is assigned to the at least one burner. In this dryer, it is provided to assign to the at least one burner an air flow generator for the transport of fresh air to the burner. The at least one air flow generator ensures a virtually forced supplying of fresh air to the burner, in that the air flow generator virtually pumps and/or forces fresh air into the burner, to be precise particularly when, due to a relatively large recirculating air component, the burner can no longer automatically draw in the fresh air necessary for optimal combustion.

Advantageously, the air flow generator is assigned to a supply line for fresh air to the respective burner, or to a common supply line for all burners. The fresh air can be transported by the at least one air flow generator in the at least one supply line directly to the or each burner.

A further advantageous embodiment of the dryer provides that the at least one air flow generator is configured to generate a variable stream of fresh air to the burner. As a result, the fresh air can be adjusted or controlled in accordance with requirements. A sufficient quantity of fresh air for optimal operation, in particular for optimal combustion, is thereby fed to the respective burner.

In one advantageous embodiment of the dryer, the air flow generator is configured as at least one fan. If a plurality of burners are present, a dedicated fan is preferably assigned to each burner, though one fan can also be jointly assigned to all burners. As a result, each burner can be specifically and, if necessary, individually supplied with fresh air in sufficient quantity.

A preferred refinement of the invention provides, behind the at least one burner, a preferably variable and/or closable feed opening for fresh air which can be mixed to the air warmed by the burner.

It can preferably be provided that at least one fan or at least one blower for the generation of a recirculating air flow, and/or a closable or variable waste air outlet for at least a part of the recirculating air, are provided. The at least one fan can generate a specific recirculating air flow, in particular a recirculating air flow having a desired flow velocity and/or a desired recirculating air stream. The closable or variable waste air outlet serves to regulate the recirculating air component which is returned to the at least one burner and, having been warmed, is fed from this back to the laundry. That part of the moist air which is not used as recirculating air can be led off into the open for evacuation of the moisture which accrues when the laundry is dried in the dryer.

BRIEF DESCRIPTION OF THE DRAWINGS

A preferred illustrative embodiment of the invention is explained in greater detail below with reference to the drawing, wherein.

DETAILED DESCRIPTION OF PREFERRED EMBODIMENTS

Figure 1:
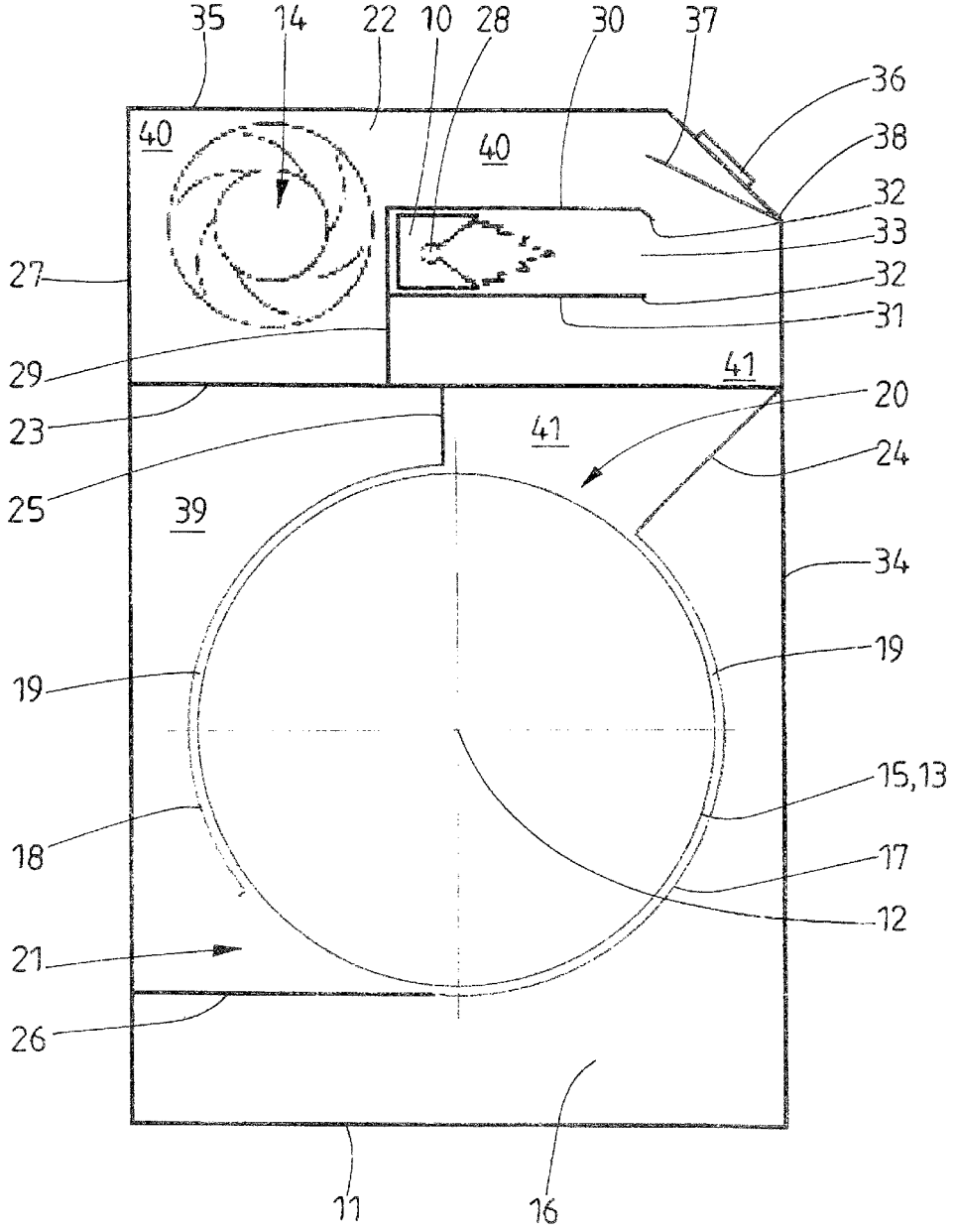
FIG. 1 shows a schematic cross section through a dryer.

The dryer represented schematically in the figures serves for the highly effective and energy efficient drying of laundry. Such a dryer is used, above all, in commercial laundries. In the dryer which is shown here, air for drying of the laundry is heated by a single burner 10. The dryer can also, however, have a plurality of burners 10 arranged in parallel or in series. The burner 10 can be constituted both by a gas burner and by an oil burner.

The dryer possesses an outer housing 11, preferably a closed, box-like housing 11, in which a drum 13, which can be driven in rotary motion about a horizontal rotational axis 12, the said burner 10, a recirculating air fan 14 and, further below, the described air guide ducts are disposed.

The rotationally drivable drum 13 serves to receive the laundry to be dried. It possesses a loading and unloading opening (not shown). In particular the casing 15 of the cylindrical drum 13 is of air-permeable configuration to enable air used for the drying to flow through the drum 13 and the initially damp laundry present therein. The drum 13 is rotatably mounted in a lower compartment 16 of the housing 11.

The drum 13 is partially surrounded at a short distance from the cylindrical casing 15 by air-impermeable, arc-shaped walls 17 and 18. The walls 17 and 18 lie on a circular path running concentrically around the rotational axis 12, whereby the air-impermeable walls 17 and 18 surround the cylindrical casing 15 of the drum 13 at a short distance apart for the formation of a narrow gap 19 between the casing 15 of the drum 13 and the walls 17 and 18. Each of the preferably equal-sized walls 17 and 18 extends over about 120° to 150°, preferably about 135°, of the periphery of the drum 13. In this way, between transverse rims, running parallel to the rotational axis 12, of different walls 17 and 18 are formed openings which are left free by these same and are diametrically opposing, to be precise an upper air inlet opening 20 and a lower air outlet opening 21. Mutually facing, spaced-apart transverse rims of the walls 17 and 18 are sealed in the region of the air inlet opening 20, with respect to a horizontal partition 23 demarcating the lower compartment 16 from an above-situated upper compartment 22, by transverse walls 24 and 25. In addition, a lower transverse rim of the (in FIG. 1) right-hand wall 17 is separated by a horizontal wall 26 to the nearest (left-hand) external wall 27 of the housing 11.

In the upper compartment 22 of the housing 11 is located, at a distance from the external wall 27, the recirculating air fan 14, though this can also be in the form of a different air flow generator, for example a blower. In addition to the recirculating air fan 14, there is also arranged in the upper compartment 22, roughly in the middle, the burner 10, to be precise such that a schematically indicated elongate flame tube 28 for generating a plurality of adjacent flames runs parallel to the rotational axis 12. The axes of the flames run horizontally, to be precise transversely to the rotational axis 12. Alternatively, the burner 10 can also be configured such that it generates just a single horizontal flame, extending transversely to the rotational axis 12.

In the shown illustrative embodiment, the burner 10 is housed in the upper compartment 22. For this purpose, a rear wall 29 is assigned to the burner 10 on the rear side. Above and beneath the burner 10 are located parallel, horizontal air guide walls 30, 31, which are both connected to the rear wall 29. Parallel, free edges 32 of the air guide walls 30 and 31 form a preferably elongate, vertical air outlet opening 33 of the housing surrounding the burner 10 and made up of the rear wall 29 and the air guide walls 30 and 31. The substantially fully open air outlet opening 33 thus forms a wide-slot opening or wide-slot nozzle. The air outlet opening 33 is distanced from an external wall 34 of the housing 11, which external wall lies opposite the external wall 27 of the housing 11. Similarly, the upper air guide wall 30 is distanced from an upper top wall 35 of the housing 11 of the dryer. Consequently, the rear wall 29, which extends only up to the upper air guide wall 30, ends also at a distance below the top wall 35 of the housing 11.

In a bevelled upper, right-hand corner region between the horizontal top wall 35 and the vertical (right-hand) external wall 34 is located an air vent 36. Below the air vent 36 is provided, inside the upper compartment 22, a recirculating air flap 37. The recirculating air flap 37 is pivotable about a horizontal pivot axis 38, preferably by a drive (not shown). The recirculating air flap 37 is pivotable to the point where it, on the one hand, in an open setting completely closes off the air vent 36 and, on the other hand, in a closed setting extends the free edge 32 of the air guide wall 30 above the burner 10 to the external wall 34 and thereby forms a seal. Between the said extreme settings, optional intermediate settings of the recirculating air flap 37 are possible.

By virtue of the above-described configuration of the housing 11, in particular of the lower compartment 16 and of the upper compartment 22, a specific air flow can be induced in the dryer. Thus, the air outlet opening 21 opens out into a backflow chamber 39 closed off by the wall 18, the transverse wall 25, the wall 26 and the external wall 27. By an opening (not shown in the figures) in the partition 23, the backflow chamber 39 in the lower compartment 16 is connected to a backflow chamber 40 in the upper compartment 22. This backflow chamber 40 is bounded by the partition 23, the top wall 35, an upper part of the external wall 27, the rear wall 29 behind the burner 10 and the air guide wall 30, distanced from the top wall 35, above the burner 10.

Between the upper part of the external wall 34 and the air outlet opening 33 situated at a distance therefrom, the chamber, surrounding the burner 10, between the air guide walls 30 and 31, the transverse walls 24, 25 and the air inlet opening 20 into the drum 13 is formed an inflow chamber 41. Via the inflow chamber 41, the upper compartment 22 and the lower compartment 16 are also connected to each other by an appropriate opening in the partition 23. When the recirculating air flap 37 is closed, the backflow chamber 40 and the inflow chamber 41 can be separated from each other. By the middle setting (shown in FIG. 1) of the recirculating air flap 37, a partial connection of the backflow chamber 40 to the inflow chamber 41 and a partial opening-up of the air vent 36 is adjustable.

Figure 3:
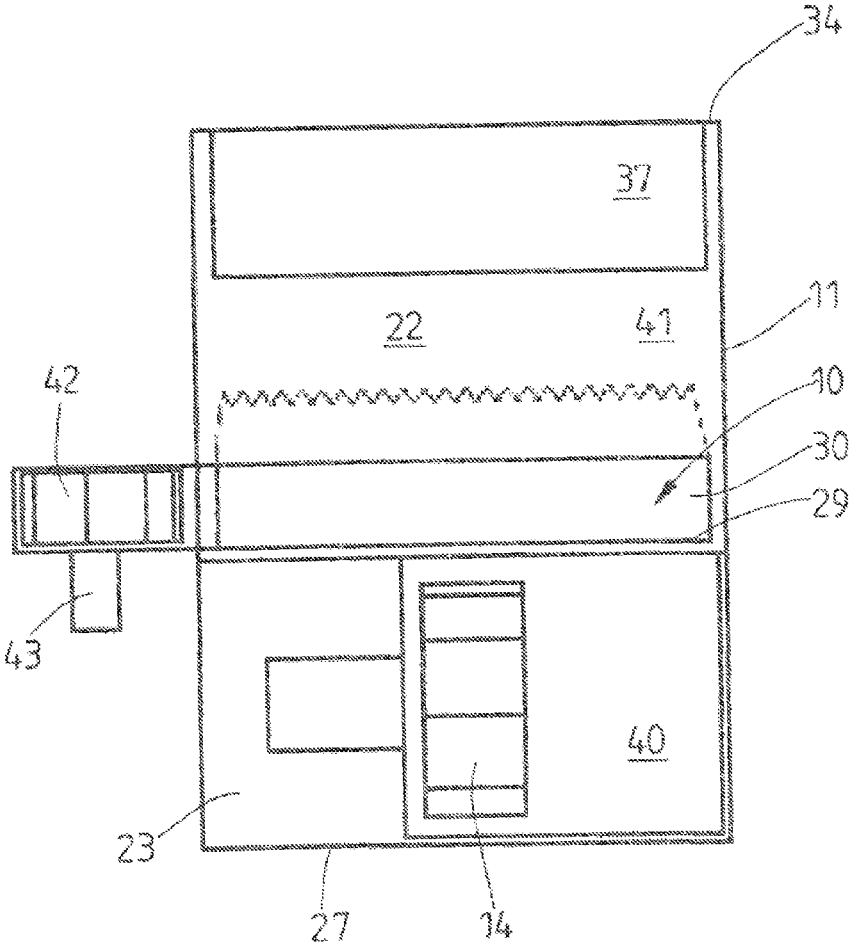
FIG. 3 shows a schematic horizontal section III-III through an upper part of the dryer in the region of a burner.

According to the invention, an air flow generator is assigned to the burner 10. This is represented symbolically in FIG. 3. This particular illustrative embodiment relates to an air flow generator configured as a fan 42. The air flow generator can also be formed by a plurality of fans 42. Through an intake opening (not shown), the fan 42 draws in fresh air from outside the housing 11 of the dryer and transports this to the burner 10, preferably into the burner 10. As a result of the lateral arrangement of the fan 42 next to the housing 11, supply air or fresh air is transported or blown by the fan into the housing 11 in a direction parallel to the rotational axis of the drum 13. The fresh air transported by the fan 42 into the housing makes its way inside the burner 10, for which purpose it flows through the housing surrounding the burner 10. If need be, it can be provided to transport the fresh air through the elongate flame tube 28, to be precise preferably together with the gas to be combusted by the burner 10. It is also conceivable, however, to feed the supply air or fresh air transported by the fan 42 to the inside of the burner 10 past the outside of the flame tube 28 or around the burner 10.

The fan 42 can be driven by, for example, an electric motor 43. Preferably, the speed of the electric motor 43 is variable or controllable or can be regulated. The throughput of fresh air or supply air through the fan 42 can thereby be altered and thus adapted to requirements. A desired stream of fresh air can thereby be transported to the burner 10.

Opening out into the inflow chamber 41, behind the air outlet opening 33 between the air guide walls 30 and 31, viewed in the direction of flow, is a fresh air socket (not represented in the figures) disposed on a wall of the housing 11. The opening of the fresh air socket is preferably variable in cross section. It is also conceivable for the fresh air socket to be able to be totally shut off. Via the fresh air socket, additional fresh air can be fed to the inflow chamber 41 (in the direction of flow) behind the burner 10 and/or outside this same. The quantity of fresh air is variable by altering the cross section of the fresh air socket. The fresh air supply via the fresh air socket can also be totally cut off.

Figure 2:
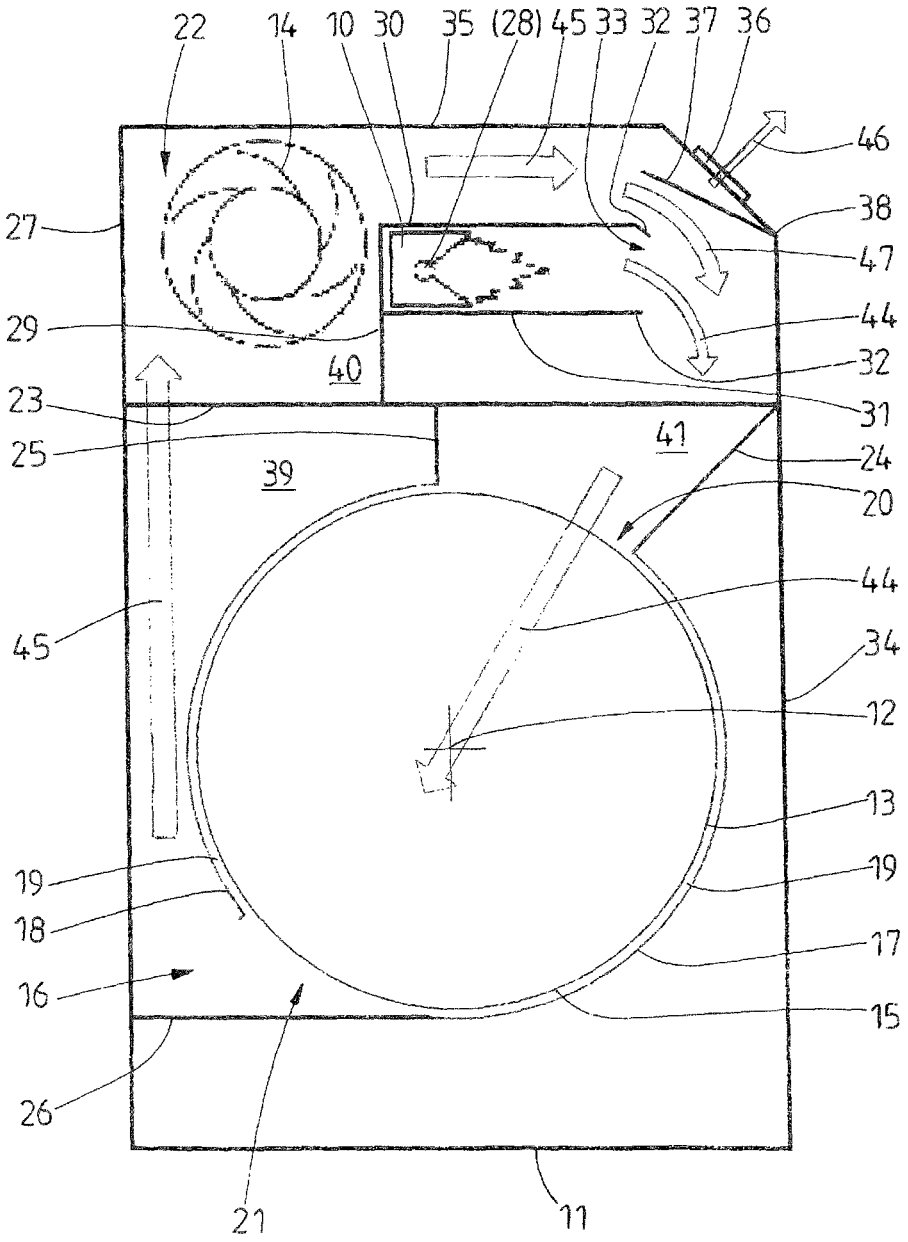
FIG. 2 shows a schematic cross section through the dryer according to FIG. 1, with arrows for illustration of the air flows.

The inventive method is explained in greater detail below with reference to the previously described dryer with reference to, in particular, FIG. 2:

The drying operation commences with the supply of air 44 heated by the burner 10 through the inflow chamber 41 and the air inlet opening 20 to the rotationally driven drum 13 in which the laundry to be dried is found. As the air 44 flows along the laundry, which initially is still very damp, the air absorbs a large amount of moisture. As a result, relatively moist air 45 leaves the drum 13 through the air outlet opening 21. The moist air 45 flows through the backflow chamber 39 in the lower part 16 into the backflow chamber 40 in the upper compartment 22, where it is transported onward by the recirculating air fan 14.

The moist air 45 containing, at the start of the drying operation, a high moisture component is initially, with the recirculating air flap 37 completely or almost completely closed, evacuated fully or for the most part through the air vent 36 from the housing 11 of the dryer, as waste air 46. As replacement for the evacuated waste air 46, fresh air is fed to the dryer from outside. This happens mainly through the burner 11, where the fresh air fed from outside serves as combustion air. This fresh air is initially drawn in automatically by the burner 10. For the support of the air supply to the burner 10, it can also already be provided in this drying stage, however, for fresh air to be transported to the burner 10 through the fan 42. Additionally or alternatively, further fresh air can, where necessary, be fed behind the burner 10 directly to the inflow chamber 41.

As the drying process progresses, the moisture content in the moist air 45 declines. Then a part of the moist air 45 is fed as recirculating air past the burner 10 and/or through the burner 10 to the drum 13 containing the laundry to be dried. For this purpose, the recirculating air flap 37 is partially opened by being pivoted in the clockwise direction (related to the representation in FIG. 2) about the pivot axis 38. The recirculating air flap 37 is opened sufficiently wide for the desired recirculating air stream to set in, i.e. a specific moist air component 45 is again fed as recirculating air 47 to the drum 13 and a remaining moist air component 45 is passed through the air vent 36 as waste air 46 into the open. That part of the moist air 45 which is passed through the air vent 36 as waste air 46 into the open is replaced by fresh air, which the fan 42 transports to the burner 10 or which can still be drawn in automatically by the burner 10. This fresh air is passed through the burner 10 and here serves as combustion air. The air leaves the burner 10 as heated air 44, which in the inflow chamber 41 mixes with the recirculating air 47 and, together with this same, is re-fed as heated air 44 to the drum 13.

In dryers, in particular of the kind for commercial laundries, recirculating air 47 is employed in order to reuse the thermal energy in the moist air 45 and avoid having to reheat so much cold fresh air. The recirculating air component 47 is therefore gradually increased with increasing drying time. To this end, the recirculating air flap 37 is gradually opened further, so that it increasingly closes the air vent 36 and little moist air 45 having still considerable residual heat escapes through the air vent 36 into the open.

As the component of moist air 45 which has been reused and returned to the burner 10, i.e. recirculating air 47, increases, the burner 10 is itself able to draw in only little fresh air from outside. Sufficient fresh air is then no longer available to the burner 10. This gives rise to an unfavorable or incomplete combustion, which, inter alia, can lead to harmful soot formation. It is therefore provided according to the invention to transport fresh air through the fan 42 to the burner 10 as the recirculating air component 47 increases. The burner 10 is then boosted or charged virtually with fresh air, which is forced or pumped through the fan 42 to the burner 10. The burner 10 thereby receives sufficient fresh air for optimal combustion, whereby, in the end phase of the drying, drying can be realized with more recirculating air than has hitherto been normal, or with recirculating air only.

If, due to the fresh air transported by the fan 42 to the burner 10, only recirculating air 47 is employed at the end of the drying operation, so that the whole of the moist air 45 is then reused as recirculating air 47, then the recirculating air flap 37 lies fully open, in that, as a result of having been pivoted up to the air vent 36, it closes this off, so that no moist air 45 can any longer flow as waste air 46 through the air vent 36 into the open and the whole of the moist air 45 can be fed back to the burner 10 as recirculating air. The burner reheats the recirculating air, so that the thereby heated recirculating air is fed back to the drum 13 containing the almost dry laundry.

The moist air 45 used as recirculating air 47 can be passed, wholly or partially with the fresh air transported by the fan 45 to the burner 10, through the burner 10. If the moist air 45 used as recirculating air is led only partially through the burner 10, a part of the moist air 45 is led past the burner 10, likewise as recirculating air, to join before the air outlet opening 33 with the air 44 heated by the burner 10 and/or warmed recirculating air, so that the recirculating air 47, and the air 44 warmed by the burner 10 and likewise formed from recirculating air 47, can be fed in its entirety through the inflow chamber 41 back to the drum 13 containing the laundry.

If the dryer is operated completely or for the most part with recirculating air 47, behind the air outlet opening 33 a bit more fresh air can, where necessary, be fed from outside directly to the inflow chamber 41. This is generally unnecessary, however, in the case of complete or almost complete recirculating air operation.

The fresh air transported by the fan 42 to the burner 10 and through this same is variable in quantity by appropriate controlling of the speed of the fan 42. It is thereby possible to alter both the stream of fresh air to and through the burner 10 and the pressure of the fresh air. The burner 10 can thereby be charged or boosted more or less strongly according to the recirculating air component 47.

At the start of the drying operation, when little circulating 47 is employed, the fan 42, if need be, can be totally switched off, so that the burner 10 then automatically draws in the necessary fresh air. Only once the recirculating air component increases, in particular predominates, or only recirculating air 47 is used, is the fan 42 started up, so that fresh air, preferably under pressure, is then transported to the burner 10 or blown into the burner 10, the pressure and/or the quantity of fresh air which is transported by the fan 42 to the burner 10 rising continuously with the increase in the recirculating air component 47. Where the dryer is operated only with recirculating air 47, the stream of fresh air and/or the pressure of the fresh air, by appropriate operation of the fan 42, reach a maximum.

REFERENCE SYMBOL LIST

10 burner
11 housing
12 rotational axis
13 drum
14 recirculating air fan
15 casing
16 lower compartment
17 wall
18 wall
19 gap
20 air inlet opening
21 air outlet opening
22 upper compartment
23 partition
24 transverse wall
25 transverse wall
26 wall
27 external wall
28 flame tube
29 rear wall
30 air guide wall
31 air guide wall
32 edge
33 air outlet opening
34 external wall
35 top wall
36 air vent
37 recirculating air flap
38 pivot axis
39 backflow chamber
40 backflow chamber
41 inflow chamber
42 fan
43 electric motor
44 air
45 moist air
46 waste air
47 recirculating air

What is claimed is:

1. A dryer for laundry, comprising:

a drum (13) for receiving the laundry to be dried;

at least one burner (10) for heating air which serves for the drying;

an air flow generator for the transport of fresh air to the at least one burner (10), the air flow generator being assigned to the at least one burner (10); and an air vent (36), which is variable at least in cross section, the air vent (36) being provided for at least a part of moist air stemming from the drum (13), wherein the air flow generator is configured (i) to transport no fresh air to the at least one burner (10) at the start of the drying operation, when only a part of the heated air which serves for the drying is returned to the at least one burner (10) as recirculating air and (ii) to actively transport fresh air to the at least one burner (10) along with an increasing part of the heated air which serves for the drying is returned to the at least one burner (10) as the recirculating air, and whereby the air flow generator is configured to generate a variable stream of fresh air to the burner (10).

2. The dryer according to claim 1, further comprising a supply line for fresh air to the burner (10), wherein the air flow generator is assigned to the supply line for fresh air to the burner (10).

3. The dryer according to claim 1, wherein the air flow generator is configured as at least one fan (42).

4. The dryer according to claim 1, further comprising a feed opening for fresh air disposed behind the at least one burner (10), wherein the fresh air is mixed with the heated air.

5. The dryer according to claim 4, wherein the feed opening is variable at least in cross section.

6. The dryer according to claim 4, wherein the feed opening is at least closable.

7. The dryer according to claim 1, further comprising an at least closable air vent (36) for at least a part of moist air stemming from the drum (13).

8. The dryer according to claim 4, further comprising at least one recirculating air fan (14) for generating a recirculating air flow for at least a part of moist air stemming from the drum (13).

9. A method for drying laundry, comprising:

heating air for drying the laundry by a burner (10);

at least during a part of the drying operation, feeding at least a part of the heated air used to dry the laundry back to the burner (10) as recirculating air, together with fresh air; and transporting the fresh air to the burner (10) at least during a part of the drying process to charge the burner (10), wherein at the start of the drying operation only a non-predominant part of the at least a part of the heated air used to dry the laundry is returned to the burner (10) as the recirculating air and no fresh air is actively transported to the at least one burner (10), and over time an increasing part of the at least a part of the heated air used to dry the laundry is returned to the burner (10) as the recirculating air along with fresh air, and wherein the fresh air is actively transported to the burner (10) only in a phase of the drying operation in which a predominant part of the at least a part of the heated air used to dry the laundry is returned to the burner (10) as the recirculating air.

10. The method according to claim 9, wherein the fresh air is transported to the burner (10) such that it is blown into the burner (10).

11. The method according to claim 10, further comprising providing a fan (42) and transporting the fresh air under pressure by the fan (42) to the burner (10).

12. The method according to claim 9, further comprising feeding additional fresh air to the air warmed by the burner (10) after the air has been warmed by the burner (10).

13. The method according to claim 12, wherein the fresh air is fed to the air warmed by the burner (10) before the warmed air reaches the laundry to be dried.

* * * * *